US006270090B1

(12) United States Patent
Gignoux

(10) Patent No.: US 6,270,090 B1
(45) Date of Patent: Aug. 7, 2001

(54) ROLLER SKATE WITH REMOVABLE BOOT

(75) Inventor: Pierre Gignoux, Coublevie (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/072,490

(22) Filed: May 4, 1998

(30) Foreign Application Priority Data

May 6, 1997 (FR) ..... 97 05862
Jan. 8, 1998 (EP) ..... 98810006

(51) Int. Cl.[7] ..... A63C 17/00
(52) U.S. Cl. ..... 280/11.33; 280/11.19
(58) Field of Search ..... 280/7.12, 7.13, 280/7.14, 11.19, 11.3, 11.33, 613, 625, 634, 842, 11.221, 11.224, 11.227, 11.231, 11.233, 14.21, 14.22, 14.23; 36/115, 131; 441/70

(56) References Cited

U.S. PATENT DOCUMENTS 2,244,719 * 6/1941 Mansfield ..... 280/11.3
3,367,669 * 2/1968 Collins ..... 280/11.3
4,177,584 * 12/1979 Beyl ..... 280/613
4,900,043 * 2/1990 Kho ..... 280/7.12
5,334,065 * 8/1994 Uren et al. ..... 441/70
5,507,506 * 4/1996 Shadroui ..... 280/11.22
5,520,406 * 5/1996 Anderson et al. ..... 280/14.2
5,595,396 * 1/1997 Bourdeau ..... 280/615
5,695,210 * 12/1997 Goss et al. ..... 280/14.2
5,741,019 * 4/1998 Lu ..... 280/11.22
5,895,061 * 4/1999 Gignoux ..... 280/11.22

FOREIGN PATENT DOCUMENTS

686492 A 4/1996 (CH) .
2836481 * 3/1979 (DE) ..... 280/613
4311630 * 8/1994 (DE) ..... 280/14.2
214558 * 3/1987 (EP) ..... 280/613
2 720 286 A 12/1995 (FR) .

* cited by examiner

*Primary Examiner*—Frank Vanaman
(74) *Attorney, Agent, or Firm*—Pitney, Hardin, Kipp & Szuch, LLP

(57) ABSTRACT

Roller skate comprising a chassis (2) equipped with rollers (3) and a boot (1) attached removably to the chassis at four points by catching and locking. Catching and locking are achieved automatically and simultaneously at all of the attachment points using a common element (8) subject to the action of an elastic means (16). Unlocking is achieved using a lever (19) articulated to the rear of the chassis and which can be used as a handle when putting the chassis on.

32 Claims, 10 Drawing Sheets

Fig. 14
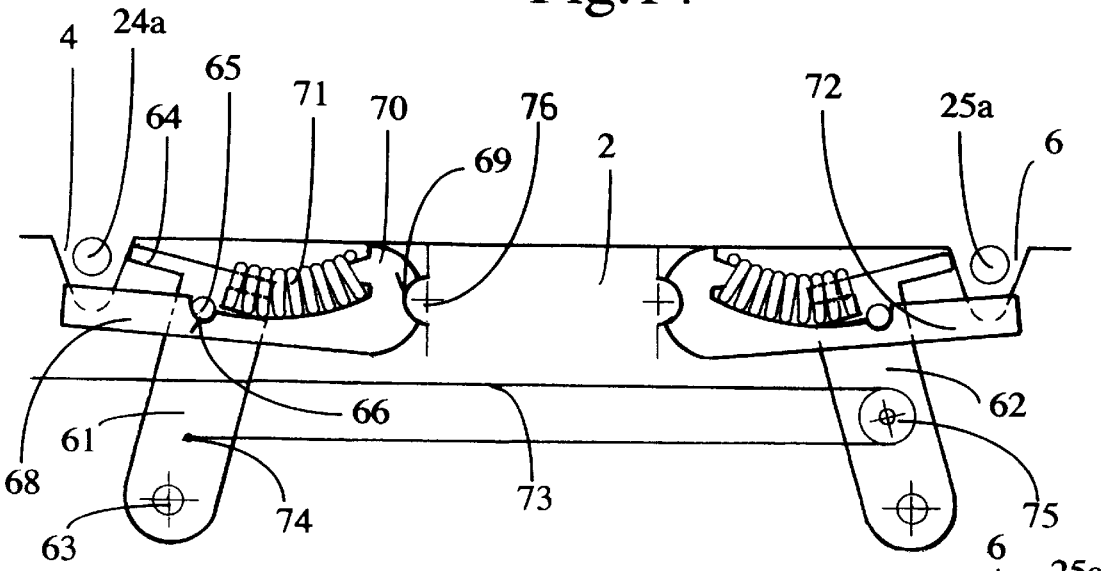
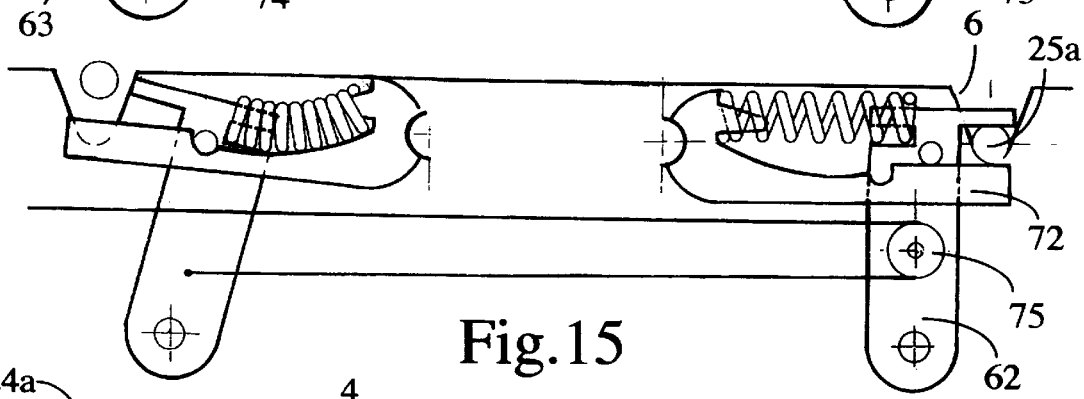
Fig. 15
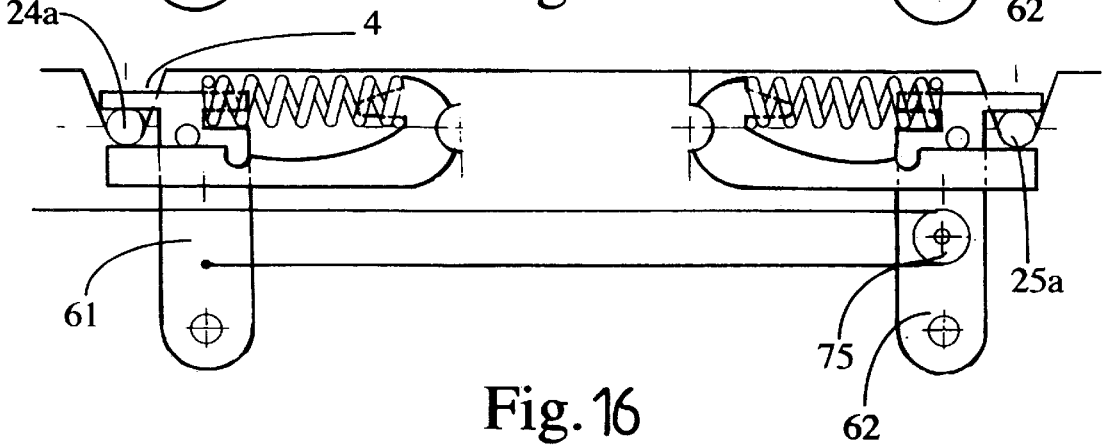
Fig. 16

ROLLER SKATE WITH REMOVABLE BOOT

FIELD OF THE INVENTION

The subject of the present invention is a roller skate comprising a chassis equipped with rollers and a boot attached removably to the chassis at four non-aligned points, by catching and locking so as to provide a stable connection between the boot and the chassis, locking being achieved automatically by the deformation of an elastic member when the roller chassis is put on.

PRIOR ART

The removable attachment of a boot to an ice skate or roller skate goes back to the beginnings of skating. Attachment was generally achieved using claws actuated by a lever and which gripped onto the sole of the boot. Such bindings are described in patent CH 118 742 and patent U.S. Pat. No. 1,402,010.

In a more modern version, described in patent U.S. Pat. No. 3,918,729, the sole of the boot is equipped with a metal plate which, at the front, has two holes in the shape of keyholes which catch on two tenons of the skate and, at the rear, a bayonet hole in which there engages a rotary member which has an actuating arm and two horizontal bars which press on two ramps so as to press the heel of the boot against the metal plate of the skate. This skate has no locking means, the binding being maintained by friction.

Patent U.S. Pat. No. 5,507,506 discloses a roller skate with a removable boot, in which skate the boot is equipped with slideways at the front and at the back, these slideways engaging over rails of the chassis. Automatic locking is achieved by a bent leaf spring over which the heel of the boot catches. An embodiment of this kind does, however, present a number of drawbacks: it is not easy to engage the slideways of the boot over the rails, especially as no play can be tolerated, and this demands a manufacturing precision or a force-fitting which are hardly acceptable or alternatively demands elastic deformation which detracts from the stability of the boot. The absence of longitudinal play in the locking is also difficult to master. Releasing the boot is somewhat inconvenient.

Patent application FR 2 720 286 furthermore discloses a roller skate with removable boot in which the boot is attached by catching at the front, whereas at the rear the boot is equipped with a latch lock device by means of which it can be attached to the rear of the chassis in order to press the heel of the boot against the chassis.

SUMMARY OF THE INVENTION

The object of the invention is to produce a simple, robust, very stable automatic binding which is free of play and easy to open in order to release the boot.

The roller skate according to the invention is one wherein automatic catching and automatic locking are achieved using at least one catching and locking element subject to the action of at least one elastic means of maintaining a locked position, and wherein the skate comprises an unlocking means consisting of an unlocking lever articulated to the rear of the chassis and acting on the catching and locking element against the action of said elastic means so as to free the boot.

According to certain embodiments, the catching and locking take place simultaneously at the four catching points using a catching and locking element common to the four points.

The unlocking lever preferably acts directly on the catching and locking element.

The unlocking lever is preferably articulated to the rear of the chassis about a horizontal axle which is transverse to the chassis. According to one embodiment, when the boot is detached from the chassis, the lever is maintained in an approximately vertical position by the catching and locking element, so that it can be used as a handle when putting on the rollers.

Advantageously, the chassis at the four catching points has V-shaped notches in which horizontal bars or tenons of the boot can engage.

According to one embodiment, the catching and locking element which is common to the four catching points has nibs which engage over the bars or tenons via inclined sides so as to press them into the bottom of the V-shaped notches. A further effect of these inclined sides is that they take up any play which is due to wear of the notches and/or of the bars or tenons.

Unequal wear of the two sides of the chassis can be compensated for by the fact that the catching and locking element is made in the form of two parallel plates with cutouts joined together by a spacer piece with play which allows longitudinal movement of one plate with respect to the other.

Automatic catching can be achieved simply by giving the inclined upper sides of the catching nibs an inclination so that the nibs part under the pressure of the bars or tenons.

This embodiment requires that the foot should press relatively heavily on the chassis in order to put it on, in order to overcome the force of the return spring. According to another embodiment, this pressure can be greatly reduced by using a catch which retains the catching and locking element in the unlocked position, this catch being positioned relative to the level of the bottom of the V-shaped notches of the chassis in such a way that it is actuated by the tenons or bars of the boot when the boot is put on. This catch can be produced in various ways.

Advantageously one and the same spring both returns the catch and returns the catching and locking element.

The unlocking lever may furthermore be used as a handle for manipulating the chassis when putting it on and as an auxiliary means for laterally holding the boot, particularly a cuff with which the boot is equipped.

BRIEF DESCRIPTION OF THE DRAWINGS

The appended drawing depicts, by way of example, a few embodiments of the invention, and some alternative forms thereof.

FIG. 8 depicts, in axial section, a second embodiment, with a catch, in the unlocked position, in a first position for putting the boot on.

FIG. 11 depicts, in axial section, a third embodiment, with a catch, in the unlocked position, in a first position of putting the boot on.

FIG. 14 is a part view, in axial section, of a fourth embodiment, with a catch, in the unlocked position, before putting the boot on.

FIG. 15 depicts this fourth embodiment after the front of the boot has been caught and locked.

FIG. 16 depicts this fourth embodiment after the rear part has been caught and locked.

DESCRIPTION OF THE PREFERRED EMBODIMENT(S)

Figure 1:
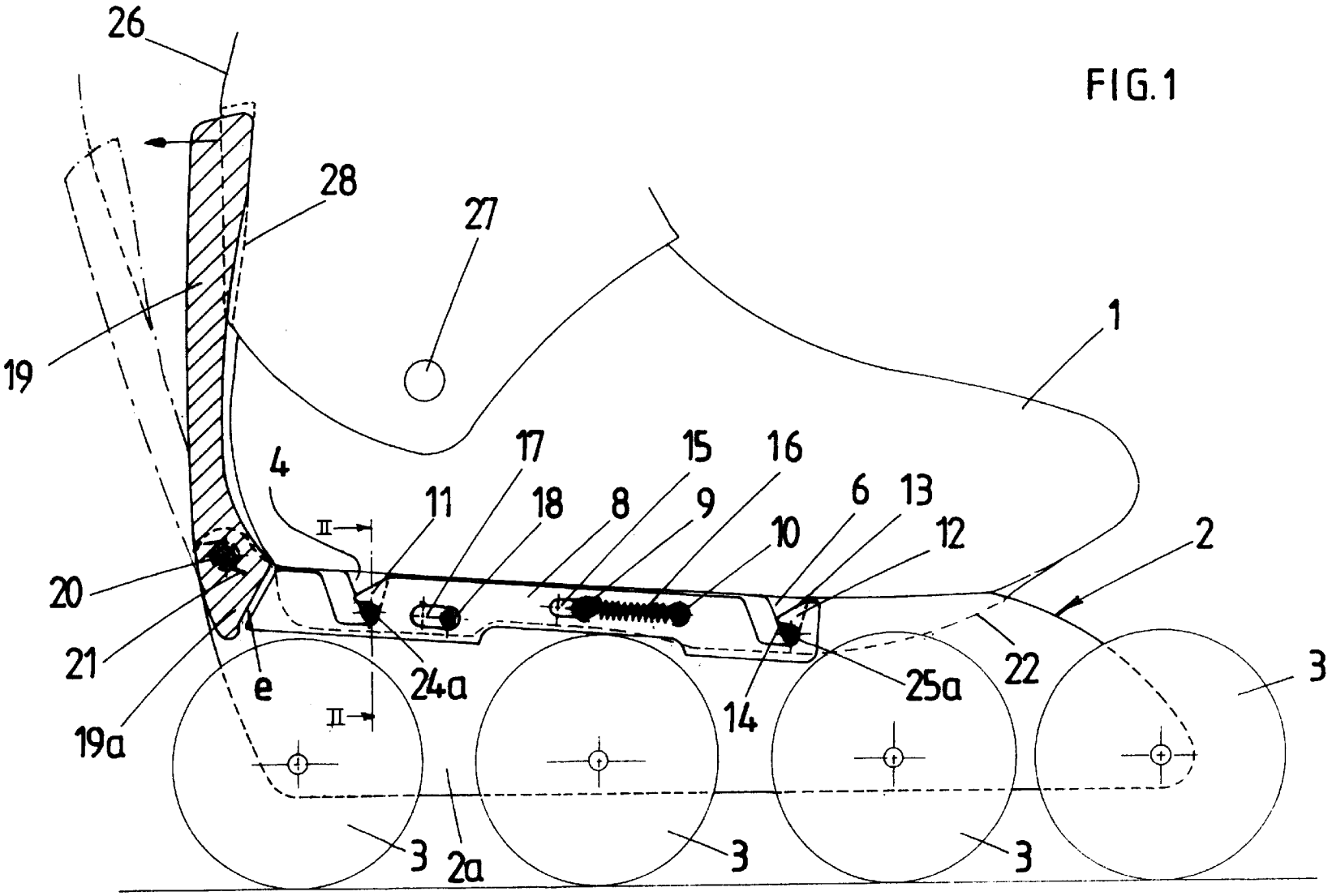
FIG. 1 is a view in axial section, on a vertical plane of symmetry of the chassis, of an in-line roller skate equipped with its boot, according to a first embodiment.

The complete skate depicted in FIG. 1 comprises a boot 1 mounted removably on a chassis 2 which is equipped with four in-line rollers 3.

Figure 2:
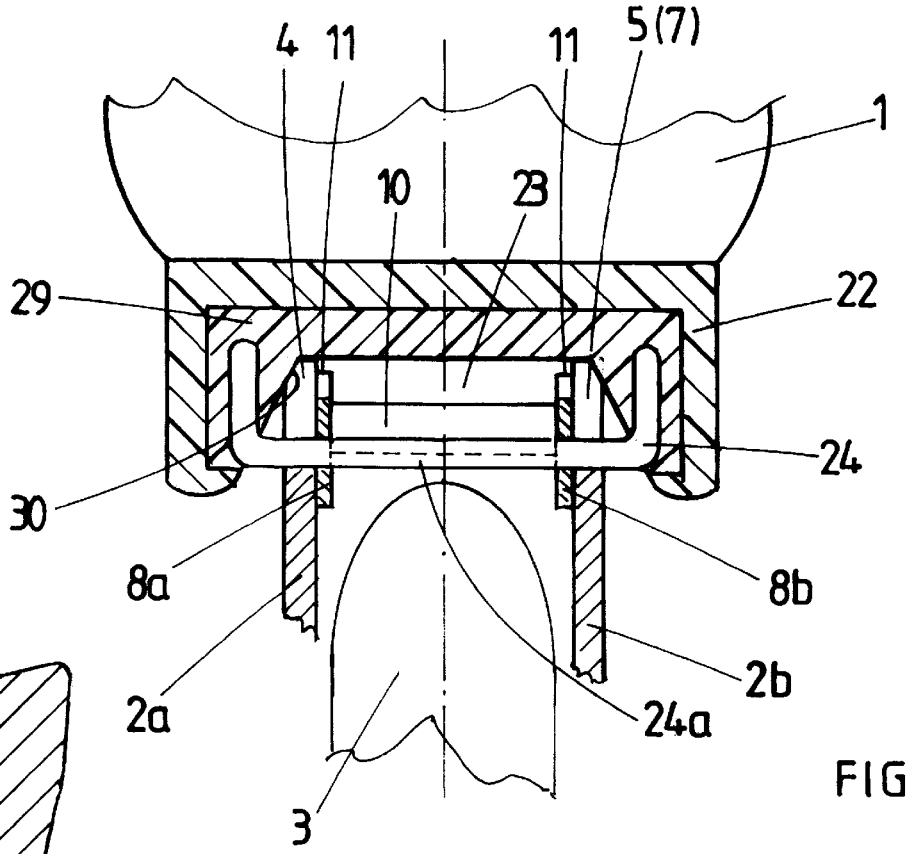
FIG. 2 is a part view in section on II—II of the chassis and of the sole of the boot.

The chassis 2 has two parallel plates 2*a* and 2*b* between which the rollers 3 are mounted. These plates are spaced apart. A chassis of this kind may be produced, for example, using an extruded aluminum section. The upper edges of the plates 2*a* and 2*b* have four V-shaped notches 4, 5, 6, 7, arranged in pairs one facing the other, as depicted in FIG. 2. The notch 7 is in line with the notch 5 in FIG. 2. The chassis furthermore comprises a catching and locking element 8 articulated at an intermediate point in the chassis 2 about an axle 9 transverse to the chassis and mounted with play, perpendicular to the plates 2*a* and 2*b*. In the example depicted, the catching and locking element 8, which for the sake of simplicity will hereafter be referred to as the latch, consists of two parallel metal plates 8*a* and 8*b* with cutouts connected by a spacer piece 10 so as to have an overall width which is approximately equal to the space between the plates 2*a* and 2*b* of the chassis. This distance is preferably about 30 mm. The connection between the spacer piece 10 and the plate 8*a* and 8*b* includes clearance, so that the plates can move slightly longitudinally with respect to each other.

The latch 8 has at the front a pair of nibs 12 and, in its rear part, has a pair of nibs 11 for catching and locking the boot as will be described later on. The distance measured logituduinally between the nips preferably exceeds 8 cm. Each of these nibs has an upper side 13 which is relatively steeply inclined toward the back of the skate (at about 45°) and a lower side 14 with a shallow inclination toward the front of the skate.

The axle 9 passes through the latch 8 through a slot 15, more specifically through two aligned slots oriented longitudinally and allowing the latch 8 to move longitudinally relative to the chassis 2. The axle 9 is connected to the spacer piece 10 by a tension spring 16 which pulls the latch 8 toward the rear of the skate. Between the slot 15 and the rear nibs 11, the latch 8 has a second set of slots 17 through which there passes, with a significant amount of play, an axle 18 which is attached transversely to the chassis 2. This axle 18 and the slot 17 provide guidance for the latch 8, but with enough vertical play that the attaching of the boot, as will be described later, is not impeded and in order to allow compensation for any play due to wear.

The chassis 2 is furthermore equipped, at the rear, with an unlocking lever 19 articulated to the chassis about a horizontal axle 20 oriented transversely to the chassis. The axle 20 is surrounded by a flat spiral spring 21 urging the lever 19 to rotate in the clockwise direction, that is to say toward the front of the skate. Using its lower lever arm 19*a*, the unlocking lever 19 pushes the latch 8 back toward the front of the skate when the lever 19 is tipped backward.

The boot 1 has a flexible sole 22 made of synthetic material which allows for easy walking. This sole 22 has a central hollow 23 extending along the entire length of the chassis 2 and the closed end of which is at least as wide as the overall width of the chassis 2. The sole 22 is overmolded over two inserts, such as the insert 29 which can be seen in FIG. 2, made of strong hard plastic. Anchored in these inserts are two U-shaped metal loops 24 and 25, the horizontal parts, 24*a* and 25*a* respectively, of which constitute a bar for attachment to the chassis. The lower edges of the inserts 29 and the bars are set back from the lower surface of the sole 22 so that they do not come into contact with the ground when walking. The inserts 29 are located at the attachment positions. They therefore barely reduce the flexibility of the sole for walking. The distance between the inserts 29 preferably exceeds 8 cm so as to ensure a nice stable attachment.

Figure 3:
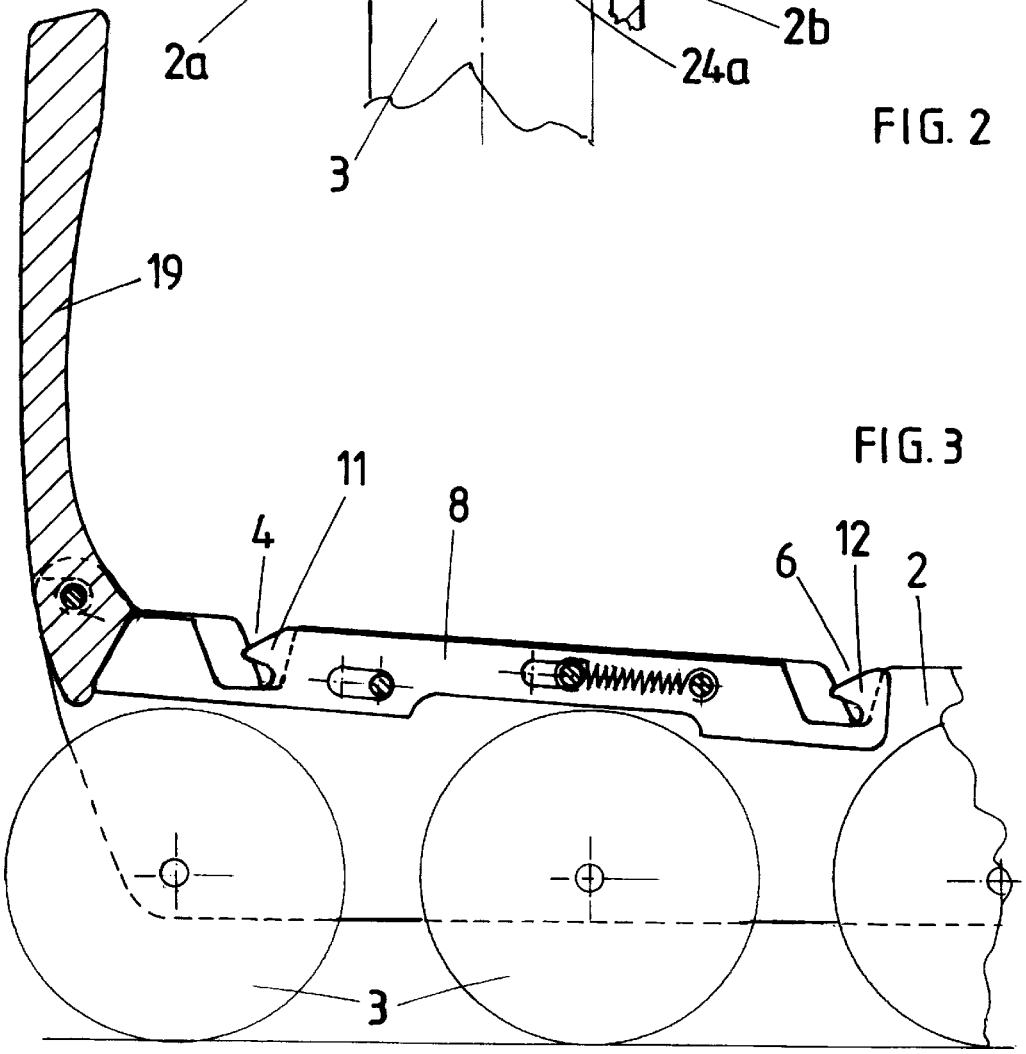
FIG. 3 is a view similar to FIG. 1, but without the boot.

For storing and transporting the chassis without the boot, the lever 19 is advantageously folded down onto the chassis. The lever 19 is stood up, for putting the boot on, in the position depicted in FIG. 3. The latch 8, pulled by its spring 16, therefore butts against the axle 9. The lever 19, urged by its spring 21, butts against the rear end of the latch 8, and is advantageously used as a handle for holding the skate. In order to put the skate on, all that is required is for the foot to be placed on the chassis 2 in such a way that the bars 24*a* and 25*a* can engage in the notches 4 to 7. The bars 24*a* and 25*a* press on the inclined sides 13 of the nibs 11 and 12 of the latch. The fact of the boot pressing on the chassis has the effect of parting the nibs 11 and 12, so that the bars 24*a* and 25*a* can penetrate right to the bottom of the V-shaped notches of the chassis. The latch 8 is then returned to the position depicted in FIG. 1 by its spring 16. The nibs 11 and 12 thus lock the bars into the bottoms of the notches. The manufacturing tolerances and any play due to wearing of the nibs and of the bars are compensated for by the inclination of the lower sides 14 of the nibs. Should the wear on each of the bars be uneven, the middle articulation of the latch 8 allows the latch 7, by tilting, to compensate for this difference in compensation for the play and/or by the relative movement of one plate 8*a*, 8*b* with respect to the other.

In the position in which the boot is on, depicted in FIG. 1, it can be seen that there is a clearance e between the unlocking lever 19 and the lock 8. This clearance is intended to allow the lever 19, which presses against a cuff 26 of the boot, which cuff is articulated about an axle 27, as is well known, to follow the pivoting movement of the cuff 26 about the axle 27. More specifically, the lever 19 bears in the bottom of a housing 28 provided in the back of the cuff 26, the lateral walls of this housing butting against the lever 19 when the cuff 26 flexes laterally, so that the lever 19 contributes to the lateral rigidity of the boot. Clearance is provided between the upper end of the lever 19 and the top of the housing 28 in order to provide the necessary freedom for movement.

The latch 8 could, of course, consist of a single-piece solid component made of metal or injection-molded synthetic substance. The bars 24*a* and 25*a* of the boot could be attached at four points, as in the example depicted, the points in actual fact being short sections of the bars, or over the entire length of that part of the bars which lies within the chassis. In any event, the connection between boot and chassis has the shape of a quadrilateral which gives the boot good lateral stability on the chassis.

The lateral holding and positioning of the boot on the chassis is provided by the trapezoidal section of the inserts 29, the oblique sides of which press on the chamfered edges 30 of the chassis 2.

The construction described hereinabove may have numerous alternative forms which fall within the scope of the invention. Some of these alternative forms will be described hereinbelow.

Figure 4:
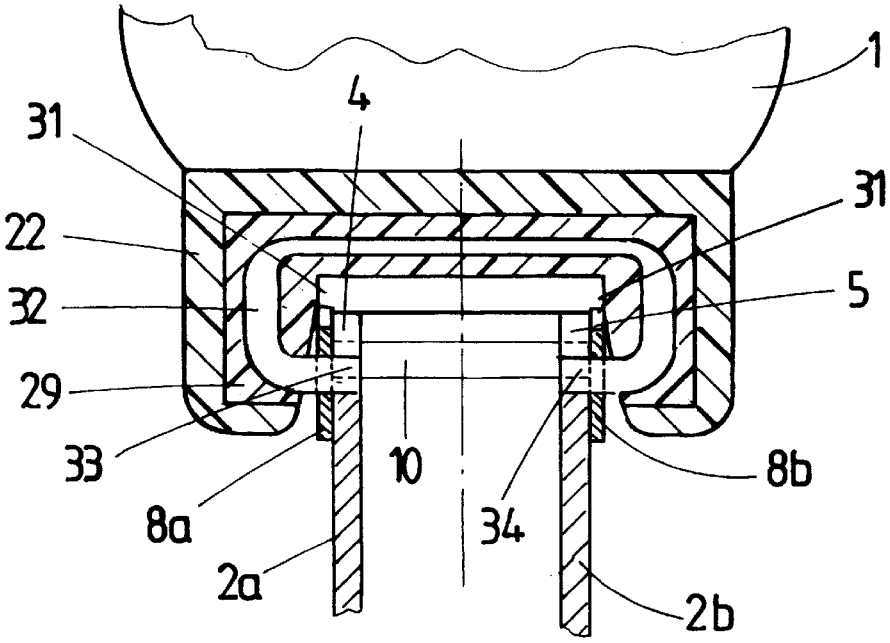
FIG. 4 is a part view, as a section similar to FIG. 2, of a first alternative form of the first embodiment.

In the alternative form depicted in FIG. 4, the parallel plates 8*a* and 8*b* constituting the latch lie on the outside of the chassis, against the outer faces of the walls 2*a* and 2*b* of the chassis. As in the first embodiment, the plates 2*a* and 2*b* are connected by a spacer piece 10 which passes this time through the walls 2*a* and 2*b* of the chassis through two slots which allow the latch to move. The plates 8*a* and 8*b* are also guided by shoulders 31 which extend over at least part of the length of the chassis.

The catching pieces secured to the chassis consist of C-shaped metal components 32 embedded in the inserts 29. The two ends of the component 32 form two tenons 33, 34 which engage in the notches 4 to 7 of the chassis and in the latch. These tenons 33 and 34 do not project or project very little into the chassis, which means that space for rollers or for housing a brake becomes free.

The plates 8*a* and 8*b* of the latch could just as well be guided, on the one hand, from below, by bearing surfaces formed on the chassis and, on the other hand, by a single pair of projections or tenons secured to the chassis and interacting with slots of the latch.

Figure 5:
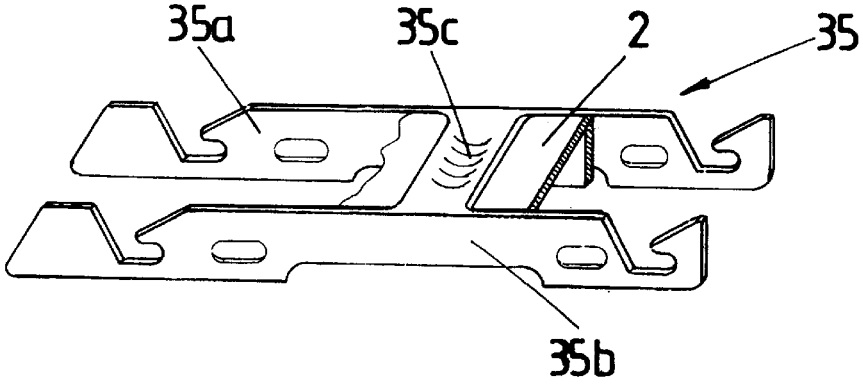
FIG. 5 is a perspective view of an alternative form of the catching and locking element.

FIG. 5 depicts one embodiment of the catch made as a single piece 35. This piece is, for example, formed by cutting and folding a metal sheet, so as to form two parallel lateral walls 35*a* and 35*b* corresponding to the plates 8*a* and 8*b* of the first embodiment, these plates 35*a* and 35*b* being connected by a bridge 35*c* in their middle, the catch 35 resting on the chassis via this bridge 35*c*, which is preferably domed slightly in the direction of the chassis and about an axle transverse to the chassis so as to constitute a surface for tilting on the chassis in order to compensate for differential play. In its middle, the piece 35 therefore has an inverted U section via which the catch sits astride the chassis.

Figure 6:
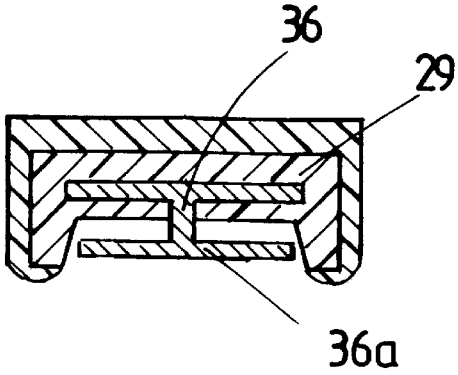
FIG. 6 is a sectional view of a first alternative form of the catching bar.

An attaching bar or attaching tenons can be obtained from components of varying shapes. In the example depicted in FIG. 6, the bar 36*a* consists of the lower bar of an I-shaped component 36 embedded in the insert 29.

Figure 7:
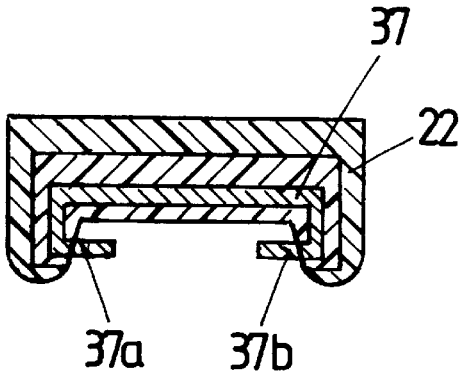
FIG. 7 is a sectional view of a second alternative form of the catching tenons.

In the alternative form depicted in FIG. 7, tenons 37*a* and 37*b* consist of the ends of a hard plastic component 37 embedded by overmolding in the sole 22. In this case, insert and bar are the same.

Figure 8:
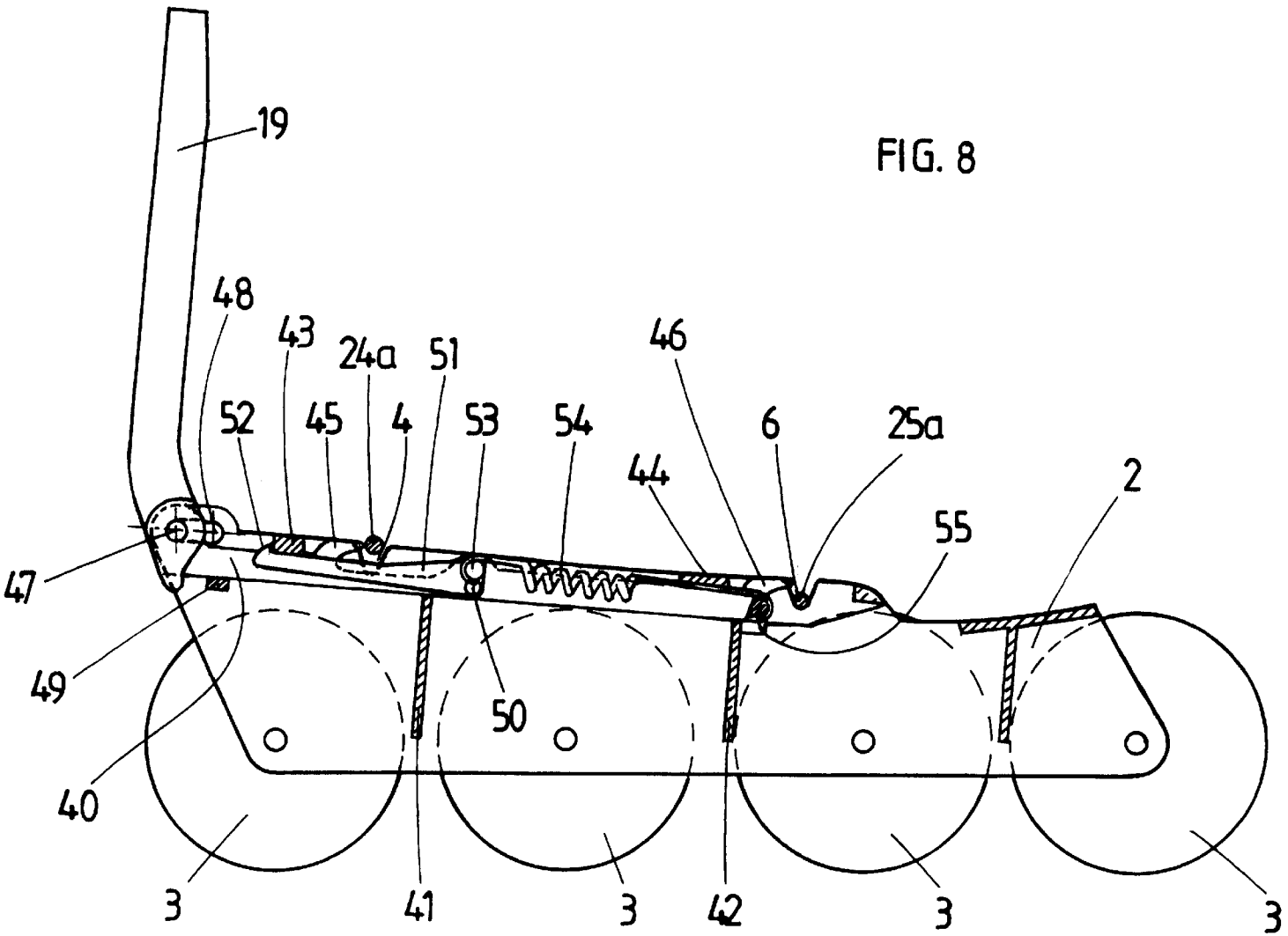
Figure 9:
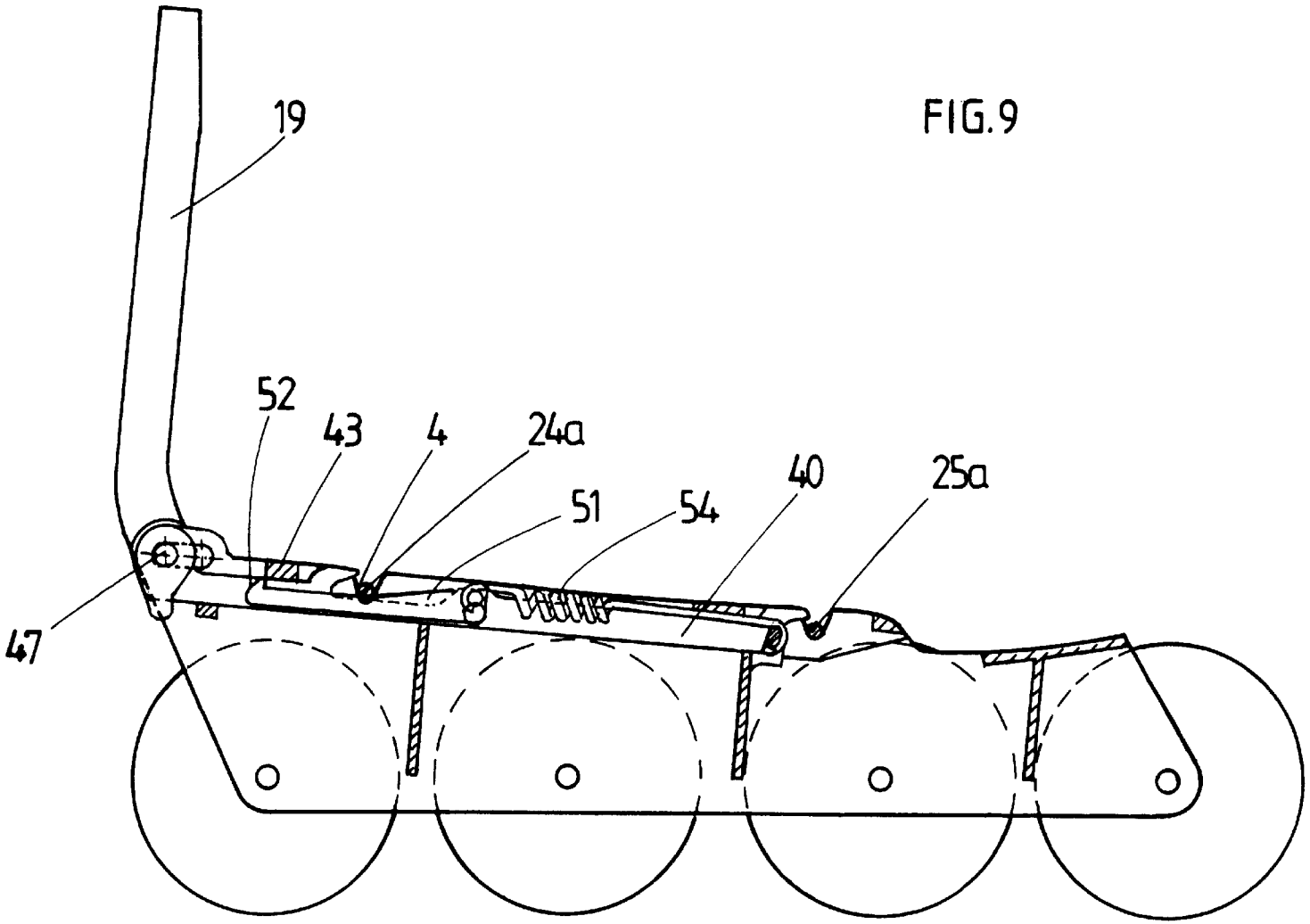
FIG. 9 depicts the second embodiment in a position immediately prior to the releasing of the catch.

A second embodiment will now be described with reference to FIGS. 8 to 10.

In order to avoid a multiplying of reference numerals, the chassis 2 and the unlocking lever 19 have been denoted by the same reference numerals as were used in the first embodiment, despite the differences in shape which may be observed. The same is true of the V-shaped notches 4 and 6.

This embodiment also comprises a catching and locking element common to the four catching points. This catching element consists of two parallel rods 40 which will hereafter be referred to by the expression latch for reasons of simplicity. This latch 40 is mounted so that it can slide longitudinally in the chassis 2, in which it is guided between, on the one hand, two spacer pieces 41 and 42 of the chassis and, on the other hand, three crossmembers 43, 44, 49 of this same chassis. The latch 40 is equipped with two hooks 45 and 46 which are intended to retain and lock the tenons 24*a* and 25*a* of the boot. The rear end of the latch 40 is articulated to the unlocking lever 19 about an axle 47 passing through the chassis 2 through a pair of longitudinal slots such as the slot 48 allowing the axle 47 to move longitudinally on the chassis. Articulated to an intermediate point of the lock 40 about an axle 50 is a catch 51 which at its end is fitted with a hook 52 via which it catches on the crossmember 43. The catch 51 is fitted with a post 53 situated just above the axle 50. Attached to this post is the end of a spring 54 which works in tension, the other end of which spring is attached to the chassis at a point 55. Given the short distance between the axle 50 and the point 53 of attachment of the spring to the catch, the spring 54 exerts on the catch 51 a torque which is relatively weak but is perfectly adequate for keeping the catch in a position caught onto the crossmember 43. This same spring 54 tends to pull the latch 40 forward with substantial force. This latch is, however, retained by the catch 51 which is itself retained by the crossmember 43. When the skate is put onto the foot, the front tenons 25*a*, 25*b* of the boot are the first to engage in the front notches 6 and 7 of the chassis, this being consistent with a normal position of the foot when putting the boot on. Hereinafter, and in order to simplify the description, we shall speak only of the tenons and V-shaped notches which are visible in the drawing. This position is depicted in FIG. 8.

The heel of the boot is then lowered so that its rear tenon 24*a* engages in the notch 4. Given that the catch 51 passes through the profile of the notch 4, as can be seen in FIG. 8, the tenon 24*a* encounters the catch and pushes it downward, as depicted in FIG. 9. When the tenon 24 meets the bottom of the notch 4, the hook 52 of the catch is released from the crossmember 43. The spring 54 can then pull the latch 40 forward so that the nibs 45 and 46 of the latch lock the tenons 24*a* and 25*a* as depicted in FIG. 10. During this movement, the lever 19 is driven by its axle 47 in the slot 48, but before it reaches the end of its travel in this slot, the lower end 19*a* of the unlocking lever 19 comes into abutment against the crossmember 49, so that the lever 19 is pulled forward and comes to press, with a certain amount of pressure, against the back of the boot. As in the first embodiment, the lever 19 may engage in a housing in the back of the boot.

Figure 10:
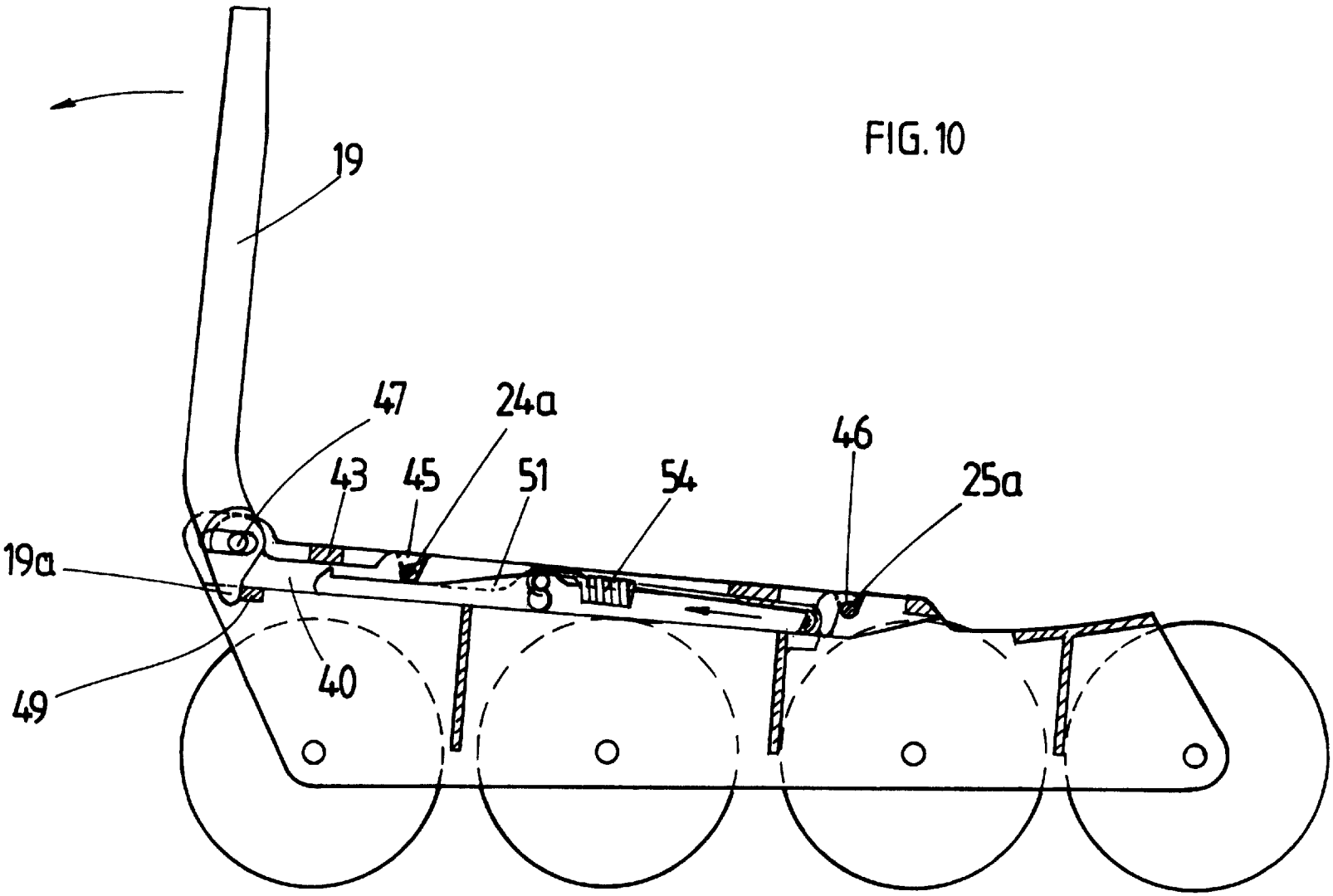
FIG. 10 depicts the second embodiment in the locked position.

In order to release the boot, all that is required is for the lever 19 to be pulled backward in the direction of the arrow, FIG. 10. The lever 19 presses on the crossmember 49 and pulls back the latch 40 with its catch 51 which again catches on 43 as depicted in FIG. 8.

In the boot-off position (FIG. 8), the lever 19 can be folded down onto the chassis.

Figure 11:
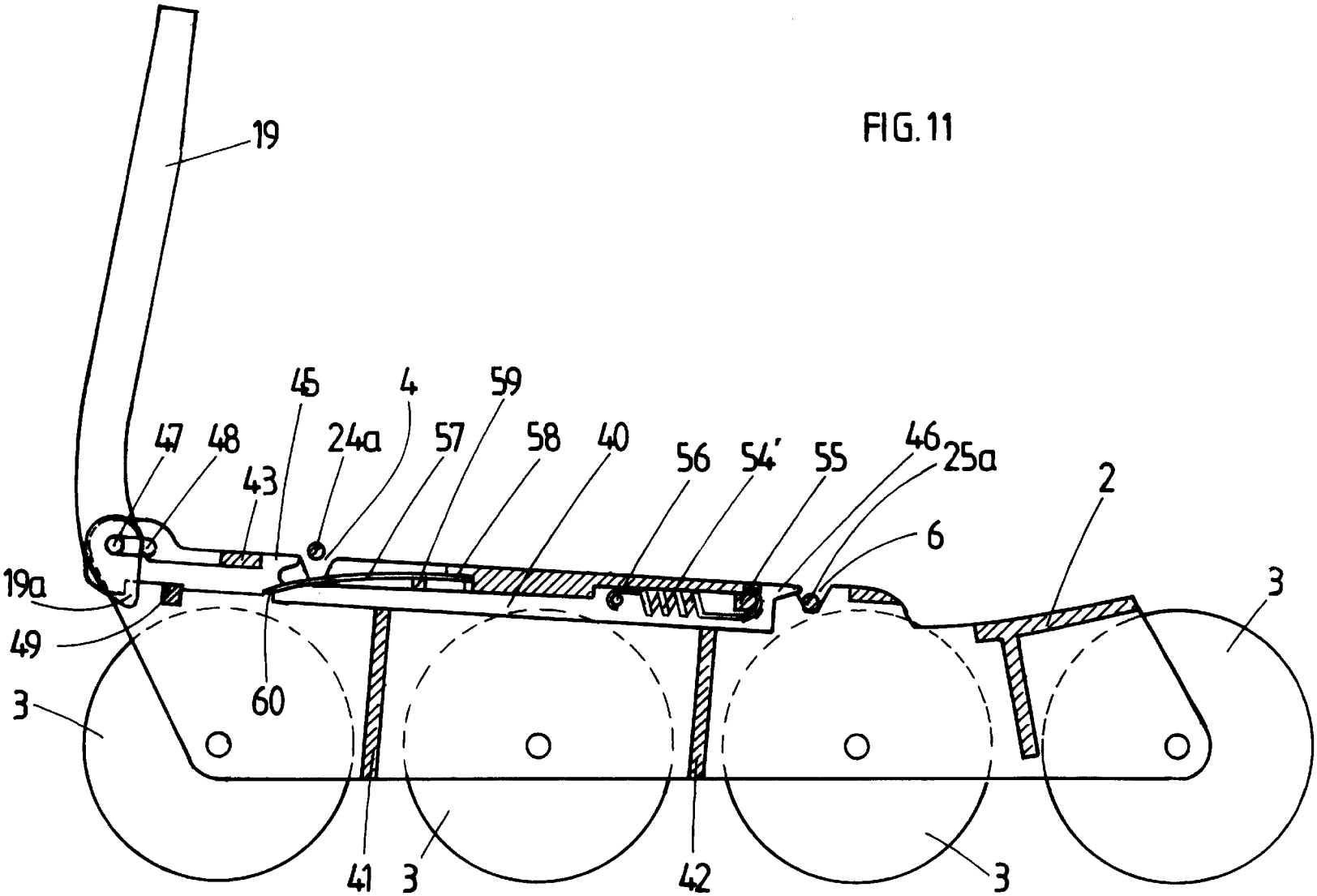
Figure 12:
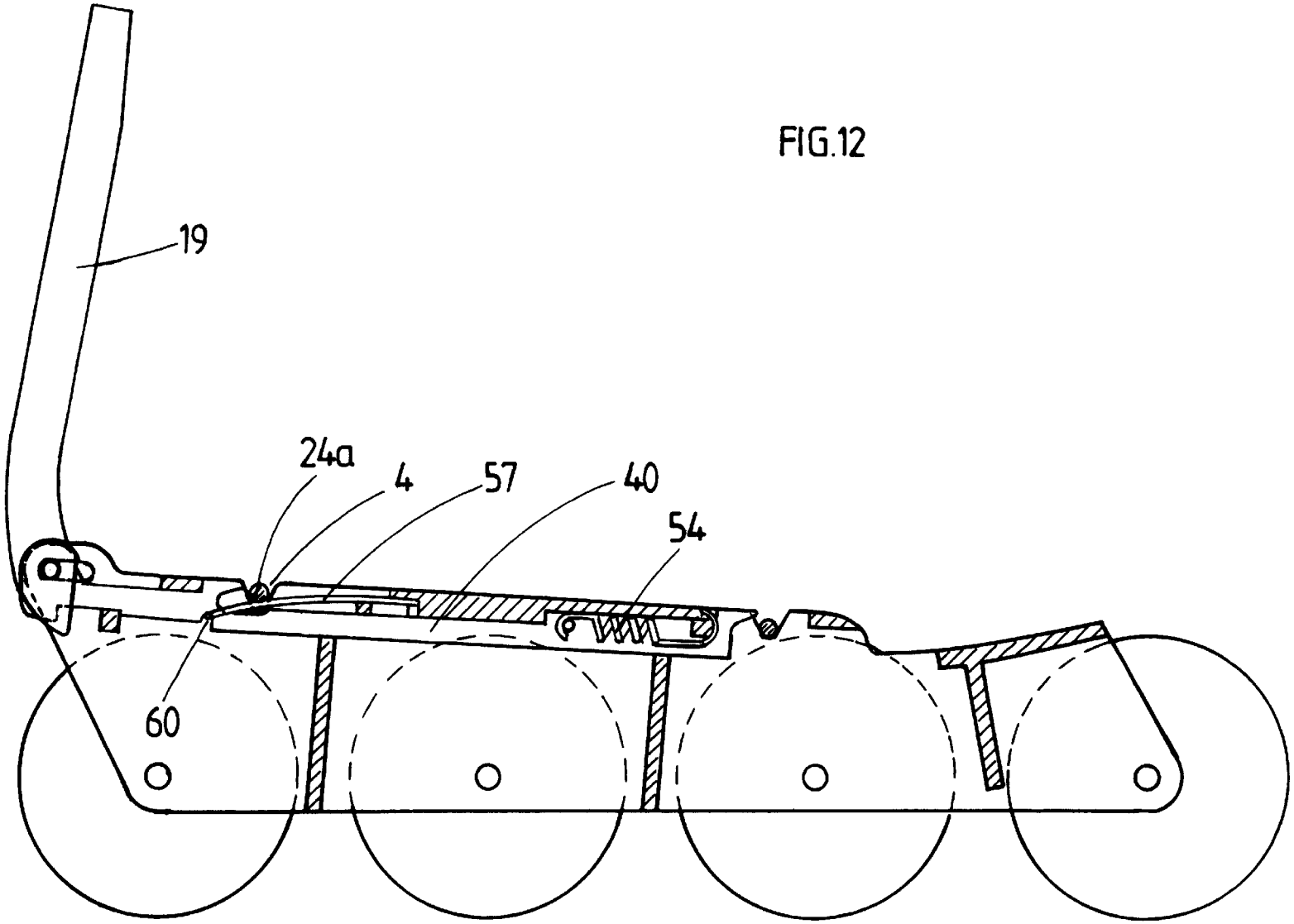
FIG. 12 depicts the third embodiment in a position immediately prior to the releasing of the catching element.
Figure 13:
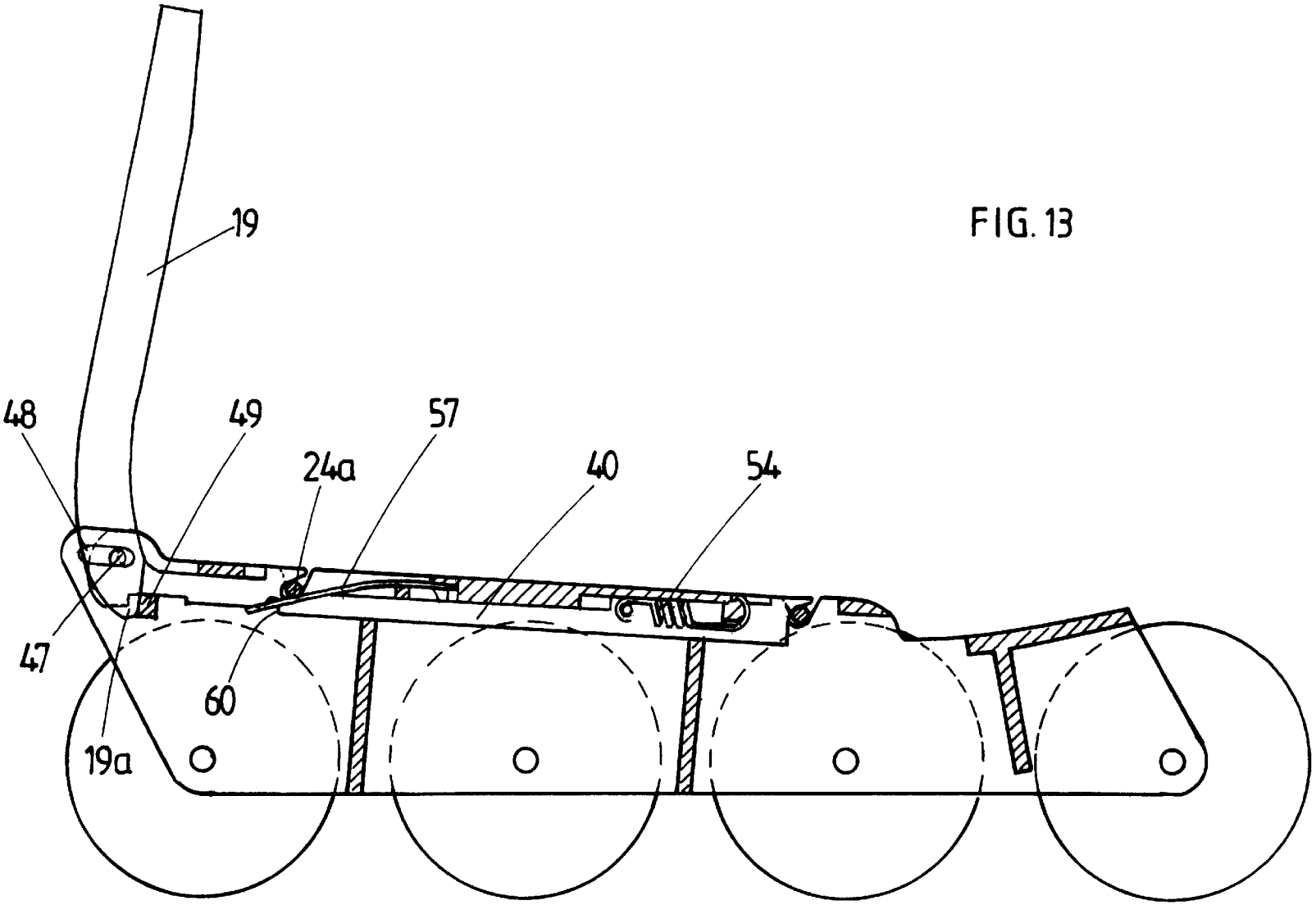
FIG. 13 depicts the third embodiment in the locked position.

The third embodiment depicted in FIGS. 11 to 13 essentially differs from the second embodiment only in the way in which the catch is produced. Thus, in order to avoid repetition, those parts which have the same function as in the second embodiment have been denoted by the same reference numerals despite possible slight differences in shape. This is the case of the latch 40 in particular. This latch 40 is guided in the same way as it was in the second embodiment and is connected to the lever 19 in an identical way. The spring 54 is attached directly to the latch 40 at a point 56. The catch here consists of a pawl 57 made of piano wire set into the chassis at a point 58 and pressing on a crossmember 59. In the unlocked position depicted in FIG. 11, this pawl 57 is flexed elastically downward and engages in a notch 60 of the latch 40, so that it retains this latch 40 which is pulled forward by the spring 54.

FIG. 11 once again depicts the first phase of putting the boot on, in which phase the front tenons 25*a*, 25*b* of the boot are engaged in the front V-shaped notches of the chassis. When the rear tenons enter the notches 4 and 5 of the chassis, the tenon 24*a* encounters the pawl 57, as depicted in FIG. 12. Once it reaches the bottom of the notch, the tenon 24*a* has pushed the pawl 57 back far enough for this pawl to escape from the notch 60 of the latch 40. This latch 40 can therefore travel forward under the effect of the spring 54', as depicted in FIG. 13. In all other respects, this embodiment is analogous to the second embodiment. In particular, upon unlocking action on the lever 19, the pawl 57 slides on the latch 40 to engage once again in the notch 60.

The notch 60 could be replaced by a simple shoulder against which the pawl 57 would press.

The third embodiment depicted in FIGS. 14 to 16 can be distinguished from the previous embodiments by the presence of distinct catching and locking elements or latches for attaching the front tenons and attaching the rear tenons of the boot.

As depicted diagrammatically in FIG. 14, catching and locking is achieved by two latches 61 and 62 working in opposite directions. These latches are produced in identical ways, which means that a detailed description of just the latch 61 will be given, remembering that this latch may consist of a single piece or of two identical pieces, one for each tenon of the boot, for example. The latch 61 is in the shape of a Γ articulated to the chassis about an axle 63 and the upper part of which forms a nib 64. This latch has a lateral post 65 which engages in a notch 66 of a catch 68 forming a lever of the first kind which, at its fulcrum, has a cylindrical cutout 69 via which this lever rests against a cylindrical boss 76 of the chassis 2 which acts as a pivot for it. The catch 68 has a short lever arm 70 against which there bears a spring 71 working in compression between the arm 70 and the latch 61 and maintaining the catch 68 against the post 65. Thus, when the post 65 of the latch is engaged in the notch 66 of the catch, the latch 61 is retained against the action of the spring 71.

When the boot is being put on, as before, it is the tenons 25*a*, 25*b* which are the first to engage in the notches 6 and 7. The tenon 25*a* encounters the catch 72 of the latch 62 and releases this latch when it reaches the bottom of the notch 6, as depicted in FIG. 15. The front of the boot is then caught and locked. It is then the rear tenons 24*a*, 24*b* which engage in the rear notches of the chassis and which, in the same way, become caught and locked by a latch 61. In this position, the tenons can part the catches of the tenons 65, unlike what has been depicted in the drawing.

Unlocking is achieved by the lever 19 via a cable 73, one end of which is attached at 74 to the rear latch 61, and which passes over a pulley 75 of the front latch 62 in order to return in the direction of the lever 19 to which it is attached by its other end.

What is claimed is:

1. A roller skate comprising a chassis (2) having a front and rear equipped with rollers (3) and a boot (1) attached removably to the chassis at four points defining a quadrilateral, by catching and locking so as to provide a stable connection between the boot and the chassis, locking being achieved automatically when the chassis is put on, wherein automatic catching and automatic locking are achieved by respective locking portions of a catching and locking element (8; 35; 40; 61, 62) located at all of the four points, the catching and locking element subject to the action of at least one elastic means (16; 54; 71) for maintaining a locked position, and wherein the skate comprises an unlocking means which includes an unlocking lever (19) articulated to the rear of the chassis and acting on the catching and locking element against the action of said elastic means so as to free the boot.

2. The skate as claimed in claim 1, wherein the unlocking lever (19) acts directly on the catching and locking element.

3. The skate as claimed in claim 2, wherein when the boot is not present, the unlocking lever (19) is maintained in an approximately vertical position by the catching and locking element (8; 35).

4. The skate as claimed in claim 1, wherein the unlocking lever (19) is articulated to the rear of the chassis about a horizontal axle (20; 47) which is transverse to the chassis.

5. The skate as claimed in claim 1, wherein the boot has a housing (28) in which a terminal region of the unlocking lever (19) is engaged in order to contribute to a lateral rigidity of the boot.

6. The skate as claimed in claim 1, wherein when the boot is absent, the unlocking lever (19) can be folded down onto the chassis.

7. The skate as claimed in claim 1, the boot further including bars or tenons, wherein the bars or tenons (24*a*, 25*a*; 33, 34; 36*a*) are anchored in hard plastic inserts (29) embedded in a flexible material (22) of a sole on the boot and have, facing the chassis, a cutout (23) with two oblique lateral walls which guide the boot when the latter is being attached to the chassis, pressing on outer sides (30) of the chassis in order to maintain and position the boot transversely on the chassis.

8. The skate as claimed in claim 1, the boot further including bars or tenons, wherein the tenons (37*a*, 37*b*) are formed by ends of a piece made of hard plastic (37) in a C shape embedded in the boot.

9. The skate as claimed in claim 1, wherein the distance measured transversely between each pair of points is about 30 mm.

10. The skate as claimed in claim 1, wherein the distance measured longitudinally between each pair of points exceeds 8 cm.

11. The skate as claimed in claim 1, wherein when the boot is absent, the unlocking lever (19) constitutes a handle for manipulating the chassis.

12. The skate as claimed in claim 1, wherein the catching and locking element (8; 35; 40) simultaneously achieves catching and locking at all the four points.

13. A roller skate comprising a chassis (2) having a front and rear equipped with rollers (3) and a boot (1) attached removably to the chassis at four points defining a quadrilateral, by catching and locking so as to provide a stable connection between the boot and the chassis, locking being achieved automatically when the chassis is put on, wherein automatic catching and automatic locking are achieved at all of the four points using at least one catching and locking element (8; 35; 40; 61, 62) subject to the action of at least one elastic means (16; 54; 71) of maintaining a locked position, said chassis has at the four points V-shaped notches (4 to 7) having respective bottoms in which horizontal bars or tenons (24*a*, 25*a*; 33, 34; 36*a*; 37*a*, 37*b*) of the boot can engage and wherein the catching and locking element has nibs (11, 12; 45, 46; 64) which engage over the bars or tenons so as to maintain the bars or tenons without play in the bottom of the V-shaped notches and wherein the skate comprises an unlocking means which includes an unlocking lever (19) articulated to the rear of the chassis and acting on the catching and locking element against the action of said elastic means so as to free the boot.

14. The skate as claimed in claim 13, wherein said elastic means comprises a spring (16) maintaining the catching and locking element in a locked position, and wherein said nibs (11, 12) have an inclined upper side (13) allowing said nibs to be parted by the bars or tenons when the boot is being put on the chassis, and an inclined lower side (14) which presses on the bars or tenons when said catching and locking element is in the locked position.

15. The skate as claimed in claim 13, wherein the catching and locking element (40; 61, 62) is kept in an unlocked position by a catch (51; 57; 68, 72) positioned relative to the bottom of said V-shaped notches (4, 6) in such a way that it is actuated by said tenons or bars of the boot when the boot is being put on the chassis, as the bars or tenons enter the V-shaped notches.

16. The skate as claimed in claim 15, wherein the catching and locking element (40; 61, 62) and the catch (51; 68, 72) have a common return spring (54; 71).

17. The skate as claimed in claim 16, wherein the catching and locking element (40) is mounted so that it can slide longitudinally in the chassis, wherein the catch (51) comprises an arm articulated at an intermediate point (50) of the catching and locking element and ending in a hook (52) which catches on the chassis in the unlocked position and wherein the common return spring (54) is a tension spring having two ends and attached by one of its ends to the chassis and by its other end to a point (53) of the catch close to the articulation (50) of the catch so as to exert simultaneously tension on the catching and locking element and a torque on the catch in order to maintain it in, and respectively to return it to a locked position.

18. The skate as claimed in claim 17, wherein the unlocking lever (19) is articulated to the catching and locking element (40) by means of an axle (47) passing through at least one longitudinal slot (48) of the chassis, the chassis having a buffer (49) against which a lower end of the lever (19) can press during unlocking.

19. The skate as claimed in claim 15, wherein the catching and locking element (40) is mounted so that it can slide longitudinally in the chassis, and wherein the catch (57) comprises a flexible member which can engage in a notch (60) or engage behind an equivalent shoulder of the catching and locking element so as to oppose the action of the elastic means (54').

20. The skate as claimed in claim 9, wherein the unlocking lever (19) is articulated to the catching and locking element (40) by means of an axle (47) passing through at least one longitudinal slot (48) of the chassis, the chassis having a buffer (49) against which a lower end of the lever (19) can press during unlocking.

21. The skate as claimed in claim 15, wherein the catching and locking element comprises two independent catching and locking elements (61, 62) each articulated about an axle situated below said V-shaped notches and equipped with a tenon (65) and two catches (68, 72) retaining each of the catching and locking elements, each catch comprising a lever extending in a direction of the tenon (65) of the catching and locking element and having a notch (66) in which said tenon is engaged in an unlocked position, and wherein said elastic means is a spring (71) working in compression between the catching and locking element and a lever arm (70) of the catch so as simultaneously to keep the catch pressed against said tenon when the boot is absent and to push the catching and locking element into a locked position.

22. The skate as claimed in claim 21, wherein the independent catching and locking elements (61, 62) work in opposite directions and in a diverging manner and wherein one of them carries a return (75) for a cable (73), one end of which is attached to the other catching element, and another end of which is connected to the unlocking lever (19).

23. The skate as claimed in claim 15, wherein the catching and locking element (8) consists of two parallel plates (8*a*, 8*b*) with cutouts, said plates being connected by a spacer piece (10).

24. The skate as claimed in claim 23, wherein said plates (8*a*, 8*b*) lie within the chassis.

25. The skate as claimed in claim 23, wherein said parallel plates (8*a*, 8*b*) lie outside the chassis, on each side thereof.

26. The skate as claimed in claim 15, wherein the catching and locking element is made as a single piece (35) with an inverted U shaped section in its middle region (35*a*) via which the catching and locking element sits astride the chassis.

27. A roller skate comprising a chassis (2) having a front and rear equipped with rollers (3) and a boot (1) attached removably to the chassis at four points defining a quadrilateral, by catching and locking so as to provide a stable connection between the boot and the chassis, locking being achieved automatically when the chassis is put on, wherein automatic catching and automatic locking are achieved at all of the four points using at least one catching and locking element (8; 35; 40; 61, 62) subject to the action of at least one elastic means (16; 54; 71) of maintaining a locked position, said catching and locking element (8) is articulated at an intermediate point about a horizontal axle (9) transverse to the chassis which passes through a slot (15) in the catching and locking element, and wherein the skate comprises an unlocking means which includes an unlocking lever (19) articulated to the rear of the chassis and acting on the catching and locking element against the action of said elastic means so as to free the boot and wherein the unlocking lever (19) acts directly on the catching and locking element and wherein when the boot is not present, the unlocking lever (19) is maintained in an approximately vertical position by the catching and locking element (8; 35).

28. The skate as claimed in claim 27, wherein, when the boot is attached to the chassis, a clearance (e) remains between the unlocking lever and the catching and locking element, so that the unlocking lever (19) presses against the boot and follows a backward and forward flexing of the boot.

29. The skate as claimed in claim 27, wherein the catching and locking element (8) consists of two parallel plates (8*a*, 8*b*) with cutouts, said plates being connected by a spacer piece (10).

30. The skate as claimed in claim 29, wherein said plates (8*a*, 8*b*) lie within the chassis.

31. The, skate as claimed in claim 29, wherein said parallel plates (8*a*, 8*b*) lie outside the chassis, on each-side thereof.

32. The skate as claimed in claim 27, wherein the catching and locking element is made as a single piece (35) with an inverted U shaped section in its middle region (35*a*) via which the catching and locking element sits astride the chassis.

* * * * *